US006789066B2

(12) United States Patent
Junkins et al.

(10) Patent No.: US 6,789,066 B2
(45) Date of Patent: Sep. 7, 2004

(54) PHONEME-DELTA BASED SPEECH COMPRESSION

(75) Inventors: Stephen Junkins, Bend, OR (US); Chris L. Gorman, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 495 days.

(21) Appl. No.: 09/961,394

(22) Filed: Sep. 25, 2001

(65) Prior Publication Data

US 2003/0061041 A1 Mar. 27, 2003

(51) Int. Cl.[7] ..... G10L 19/00

(52) U.S. Cl. ..... 704/500; 704/256

(58) Field of Search ..... 704/201, 500, 704/501, 256

(56) References Cited

U.S. PATENT DOCUMENTS 6,304,845 B1 * 10/2001 Hunlich et al. ..... 704/259
6,594,631 B1 * 7/2003 Cho et al. ..... 704/268

FOREIGN PATENT DOCUMENTS

JP 411143483 * 5/1999 ..... G10L/3/00

* cited by examiner

*Primary Examiner*—Daniel Abebe
(74) *Attorney, Agent, or Firm*—Blakely, Sokoloff, Taylor & Zafman LLP

(57) ABSTRACT

An arrangement is provided for compressing speech data. Speech data is compressed based on a phoneme stream, detected from the speech data, and a delta stream, determined based on the difference between the speech data and a speech signal stream, generated using the phoneme stream with respect to a voice font. The compressed speech data is decompressed into a decompressed phoneme stream and a decompressed delta stream from which the speech data is recovered.

32 Claims, 9 Drawing Sheets

PHONEME-DELTA BASED SPEECH COMPRESSION

RESERVATION OF COPYRIGHT

This patent document contains information subject to copyright protection. The copyright owner has no objection to the facsimile reproduction by anyone of the patent document or the patent, as it appears in the U.S. Patent and Trademark Office files or records but otherwise reserves all copyright rights whatsoever.

BACKGROUND

Aspects of the present invention relate to data compression in general. Other aspects of the present invention relate to speech compression.

Compression of speech data is an important problem in various applications. For example, in wireless communication and voice over IP (VoIP), effective real-time transmission and delivery of voice data over a network may require efficient speech compression. In entertainment applications such as computer games, reducing the bandwidth for transmitting player to player voice correspondence may have a direct impact on products' quality and end users' experience.

Different speech compression schemes have been developed for various applications. For example, a family of speech compression methods are based on linear predictive coding (LPC). LPC utilizes the coefficients of a set of linear filters to code speech data. Another family of speech compression methods is phoneme based. Phonemes are the basic sounds of a language that distinguish different words in that language. To perform phoneme based coding, phonemes in speech data are extracted so that the speech data can be transformed into a phoneme stream which is represented symbolically as a text string, in which each phoneme in the stream is coded using a distinct symbol.

With a phoneme based coding scheme, a phonetic dictionary may be used. A phonetic dictionary characterizes the sound of each phoneme in a language. It may be speaker dependent or speaker independent and can be created via training using recorded spoken words collected with respect to the underlying population (either a particular speaker or a pre-determined population). For example, a phonetic dictionary may describe the phonetic properties of different phonemes in terms of expected rate, tonal, pitch, and volume qualities.

To recover speech from a phoneme stream, the waveform of the speech may be reconstructed by concatenating the waveforms of individual phonemes. The waveforms of individual phonemes are determined according to a phonetic dictionary. When a speaker dependent phonetic dictionary is employed, a speaker identification may also be transmitted with the compressed phoneme stream to facilitate the reconstruction.

With phoneme based approaches, if the acoustic properties of a speech deviate from the phonetic dictionary, the reconstruction may not yield a speech that is reasonably close to the original speech. For example, if a speaker dependent phonetic dictionary is created using a speaker's voice in normal conditions, when the speaker has a cold or speaks with a raised voice (corresponding to higher pitch), the distinct acoustic properties associated with the spoken words under an abnormal condition may not be truthfully recovered. When a speaker independent phonetic dictionary is used, the individual differences among different speakers may not be recovered. This is due to the fact that existing phoneme based speech coding methods do not encode the deviations of a speech from the typical speech pattern described by a phonetic dictionary.

BRIEF DESCRIPTION OF THE DRAWINGS

The present invention is further described in terms of exemplary embodiments, which will be described in detail with reference to the drawings. These embodiments are non-limiting exemplary embodiments, in which like reference numerals represent similar parts throughout the several views of the drawings, and wherein:

FIG. 4(*b*) illustrates an exemplary structure of a delta compressor;

DETAILED DESCRIPTION

The invention is described below, with reference to detailed illustrative embodiments. It will be apparent that the invention can be embodied in a wide variety of forms, some of which may be quite different from those of the disclosed embodiments. Consequently, the specific structural and functional details disclosed herein are merely representative and do not limit the scope of the invention.

The processing described below may be performed by a properly programmed general-purpose computer alone or in connection with a special purpose computer. Such processing may be performed by a single platform or by a distributed processing platform. In addition, such processing and functionality can be implemented in the form of special purpose hardware or in the form of software being run by a general-purpose computer. Any data handled in such processing or created as a result of such processing can be stored in any memory as is conventional in the art. By way of example, such data may be stored in a temporary memory, such as in the RAM of a given computer system or subsystem. In addition, or in the alternative, such data may be stored in longer-term storage devices, for example, magnetic disks, rewritable optical disks, and so on. For purposes of the disclosure herein, a computer-readable media may comprise any form of data storage mechanism, including such existing memory technologies as well as hardware or circuit representations of such structures and of such data.

Figure 1:
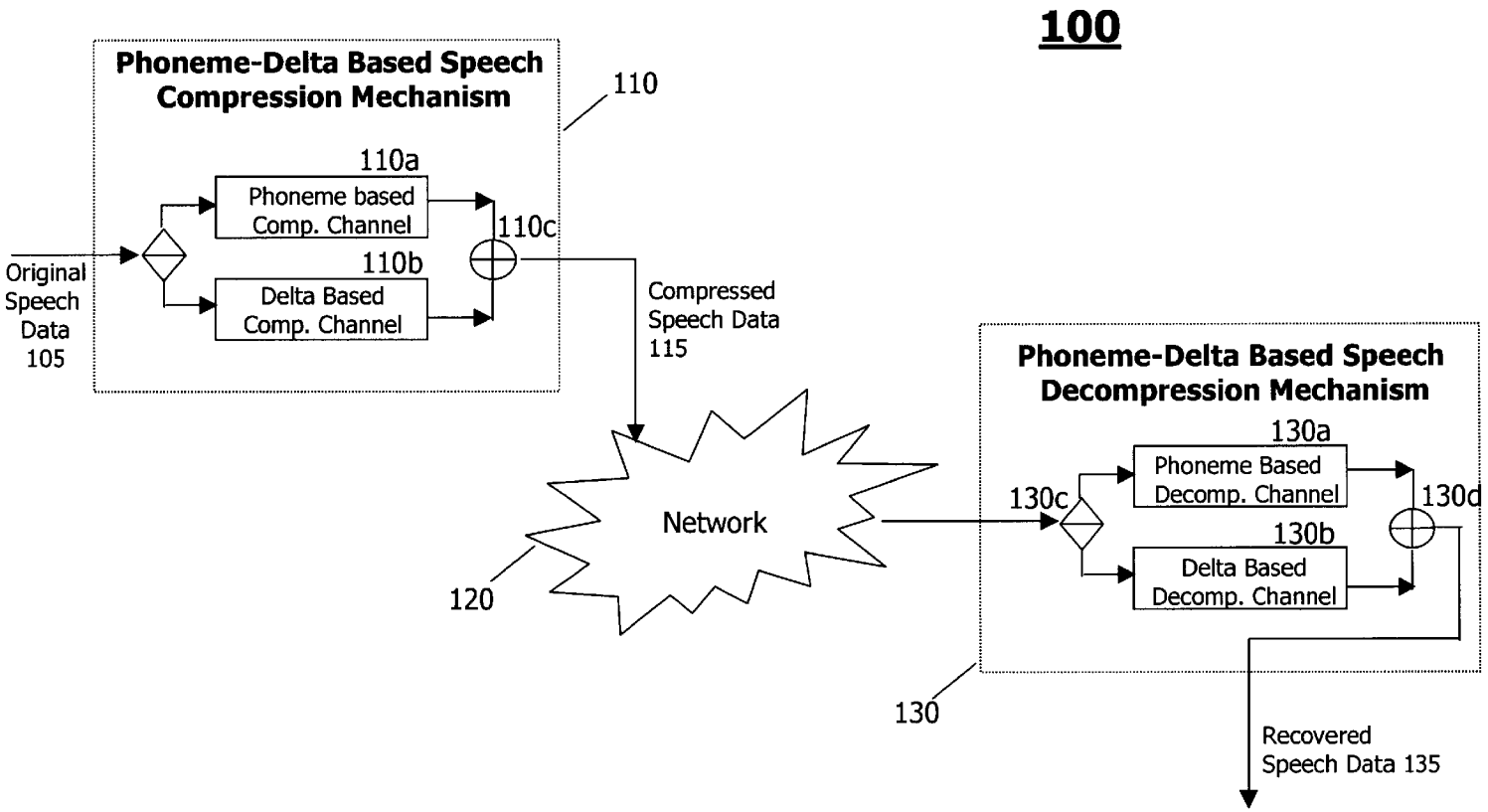
FIG. 1 depicts a mechanism in which phoneme-delta based compression and decompression is applied to speech data that is transmitted over a network.

FIG. 1 depicts a mechanism 100 for phoneme-delta based speech compression and decompression. In FIG. 1, a phoneme-delta based speech compression mechanism 110 compresses original speech data 105, transmits the compressed speech data 115 over a network 120, and the received compressed speech data is then decompressed by a phoneme-delta based speech decompression mechanism 130 to generate recovered speech data 135. Both the original speech data 105 and the recovered speech data 135 represent acoustic speech signal, which may be in digital waveform. The network 120 represents a generic network such as the Internet, a wireless network, or a proprietary network.

The phoneme-delta based speech compression mechanism 110 comprises a phoneme based compression channel 110*a*, a delta based compression channel 110*b*, and an integration mechanism 110*c*. The phoneme based compression channel 110*a* compresses a stream of phonemes, detected from the original speech data 105, and generates a phoneme compression, which characterizes the composition of the phonemes in the original speech data 105.

The delta based compression channel 110*b* generates a delta compression by compressing a stream of deltas, computed based on the discrepancy between the original speech data 105 and a baseline speech signal stream generated based on the stream of phonemes with respect to a voice font. A voice font provides the acoustic signature of baseline phonemes and may be developed with respect to a particular speaker or a general population. A voice font may be established during, for example, an offline training session during which speeches from the underlying population (individual or a group of people) are collected, analyzed, and modeled.

The phoneme compression and the delta compression, generated in different channels, characterize different aspects of the original speech data 105. While the phoneme compression describes the composition of the phonemes in the original speech data 105, the delta compression describes the deviation of the original speech data from a baseline speech signal generated based on a phoneme stream with respect to a voice font.

The integration mechanism 110*c* in FIG. 1 combines the phoneme compression and the delta compression and generates the compressed speech data 115. The original speech data 105 is transmitted across the network 120 in its compressed form 115. When the compressed speech data 115 is received at the receiver end, the phoneme-delta based speech decompression mechanism 130 is invoked to decompress the compressed speech data 115. The phoneme-delta based speech decompression mechanism 130 comprises a decomposition mechanism 130*c*, a phoneme based decompression channel 130*a*, a delta based decompression channel 130*b*, and a reconstruction mechanism 130*d*.

Upon receiving the compressed speech data 115 and prior to decompression, the decomposition mechanism 130*c* decomposes the compressed speech data 115 into phoneme compression and delta compression and forwards each compression to an appropriate channel for decompression. The phoneme compression is sent to the phoneme based decompression channel 130*a* and the delta compression is sent to the delta based decompression channel 130*b*.

The phoneme based decompression channel 130*a* decompresses the phoneme compression and generates a phoneme stream, which corresponds to the composition of the phonemes detected from the original speech data 105. The decompressed phoneme stream is then used to produce a phoneme based speech stream using the same voice font that is used by the corresponding compression mechanism. Such generated speech stream represents a baseline corresponding to the phoneme stream with respect to the voice font.

The delta based decompression channel 130*b* decompresses the delta compression to recover a delta stream that describes the difference between the original speech data and the baseline speech signal generated based on the phoneme stream. Based on the speech signal stream, generated by the phoneme based decompression channel 130*a*, and the delta stream, recovered by the delta based decompression channel 130*b*, the reconstruction mechanism 130*d* integrates the two and generates the recovered speech data 135.

Figure 2:
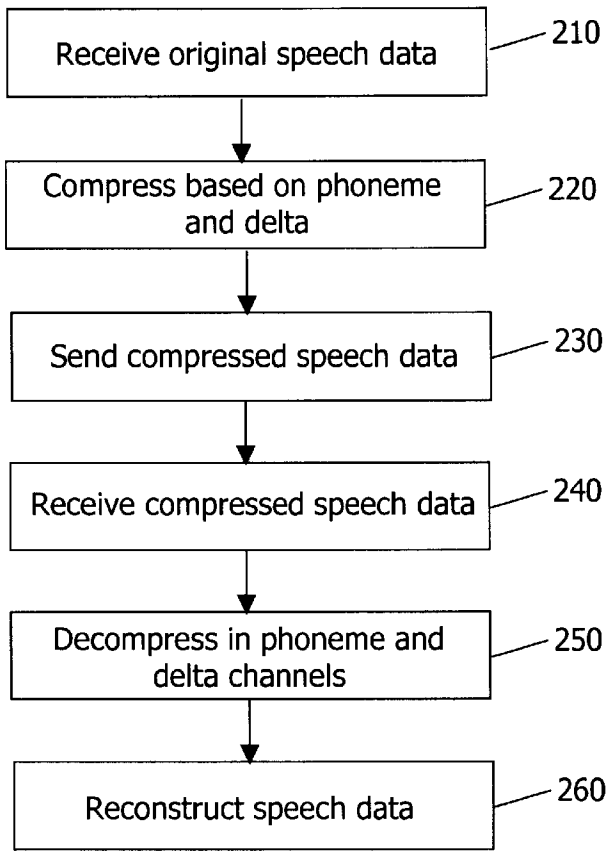
FIG. 2 is an exemplary flowchart of a process, in which speech data is transmitted across network using phoneme-delta based compression and decompression scheme.

FIG. 2 shows an exemplary flowchart of a process, in which the original speech data 105 is transmitted across network 120 using phoneme-delta based compression and decompression scheme. The phoneme-delta based speech compression mechanism 110 first receives the original speech data 105 at act 210 and compresses the data in both phoneme and delta channels at act 220. The compressed speech data 115 is then sent, at act 230, via the network 120. The compressed speech data 115 is then further forwarded to the phoneme-delta based decompression mechanism 130.

Upon receiving the compressed speech data 115 at act 240, the phoneme-delta based speech decompression mechanism 130 decompresses, at act 250, the compressed data in separate phoneme and delta channels. One channel produces a speech signal stream that is generated based on the decompressed phoneme stream and a voice font. The other channel produces a delta stream that characterizes the difference between the original speech and a baseline speech signal stream. The speech signal stream and the delta stream are then used to reconstruct, at act 260, the recovered speech data 135.

Figure 3:
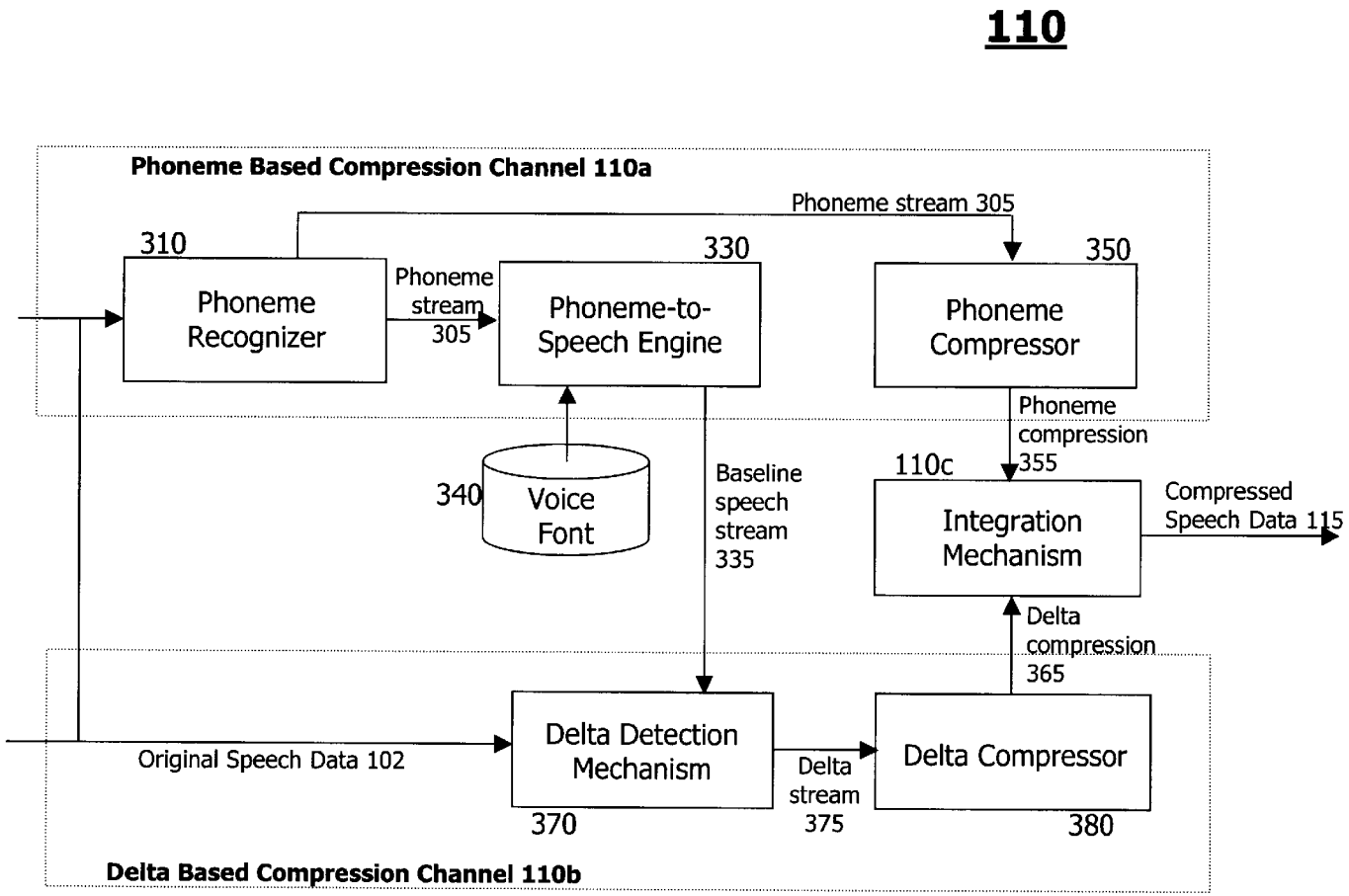
FIG. 3 depicts the internal high level structure of a phoneme-delta based speech compression mechanism.

FIG. 3 depicts the internal high level structure of the phoneme-delta based speech compression mechanism 110. As discussed earlier, the phoneme-delta based speech compression mechanism 110 includes a phoneme based compression channel 110*a*, a delta based compression channel 110*b*, and an integration mechanism 110*c*. The phoneme based compression channel 110*a* compresses the phonemes of the original speech data 105 and generates a phoneme compression 355. The delta based compression channel 110*b* identifies the difference between the original speech data 105 and a baseline speech stream, generated based on the detected phoneme stream with respect to a voice font 340, and compresses the difference to generate a delta compression 365. The integration mechanism 110*c* then takes the phoneme compression 355 and the delta compression 365 to generate the compressed speech data 115.

The phoneme based compression channel 110*a* comprises a phoneme recognizer 310, a phoneme-to-speech engine 330, and a phoneme compressor 350. In this channel, phonemes are first detected from the original speech data 105. The phoneme recognizer 310 recognizes a series of phonemes from the original speech data 105 using some known phoneme recognition method. The detection may be performed with respect to a fixed set of phonemes. For example, there may be a pre-determined number of phonemes in a particular language, and each phoneme may correspond to a distinct pronunciation.

The detected phoneme stream may be described using a text string in which each phoneme may be represented using a name or a symbol pre-defined for the phoneme. For example, in English, text string "/a/" represents the sound of "a" as in "father". The phoneme recognizer 310 generates the phoneme stream 305, which is then fed to the phoneme-to-speech engine 330 and the phoneme compressor 350. The phoneme compressor 350 compresses the phoneme stream 305 (or the text string) using certain known text compression technique to generate the phoneme compression 355.

Figure 4A:
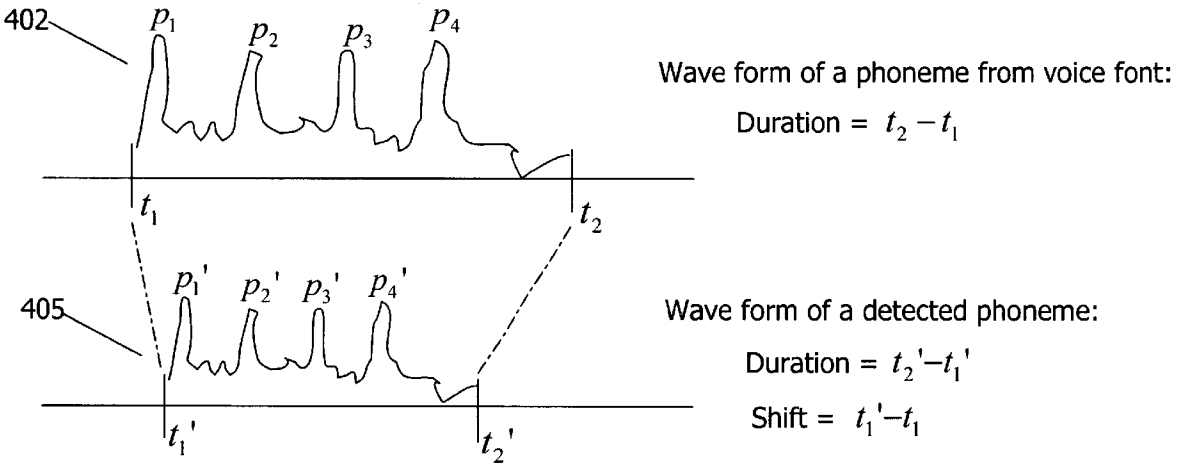
FIG. 4(*a*) compares the wave form of a voice font for a phoneme with the wave form of the corresponding detected phoneme.
Figure 4B:
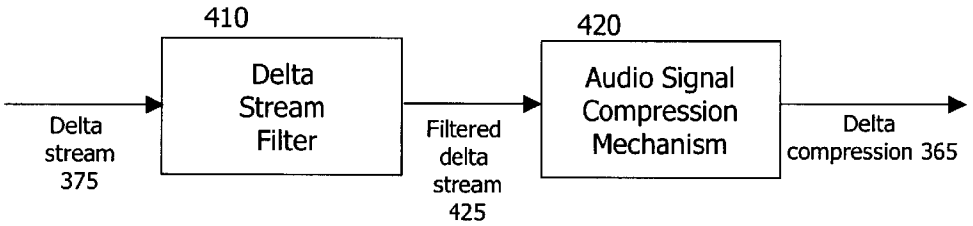

To assist the delta based compression channel 110*b* to generate a delta stream 375, the phoneme-to-speech engine 330 synthesizes a baseline speech stream 335 based on the phoneme stream 305 and the voice font 340. The voice font 340 may correspond to a collection of waveforms, each of which corresponds to a phoneme. FIG. 4(*a*) illustrates an example waveform 402 of a phoneme from a voice font. The waveform 402 has a number of peaks ($P_1$ to $P_4$) and a duration $t_2$–$t_1$. The phoneme-to-speech engine 330 in FIG. 3 constructs the baseline speech stream 335 as a continuous waveform, synthesized by concatenating individual waveforms from the voice font 340 in a sequence consistent with the order of the phonemes in the phoneme stream 305.

The delta based compression channel 110*b* comprises a delta detection mechanism 370 and a delta compressor 380. The delta detection mechanism 370 determines the delta stream 375 based on the difference between the original speech data 105 and the baseline speech stream 335. For example, the delta stream 375 may be determined by subtracting the baseline speech stream 375 from the original speech data 105.

Proper operations may be performed before the subtraction. For example, the signals from the baseline speech stream 375 may need to be properly aligned with the original speech data 105. FIG. 4(*a*) illustrates the need. In FIG. 4(*a*), the baseline waveform 402 corresponds to a phoneme from the voice font 340. The waveform 405 corresponds to the same phoneme detected from the original data 105. Both have four peaks with yet different spacing (the spacing among the peaks of the waveform 405 is smaller than the spacing among the peaks of the waveform 402). The resultant duration of the waveform 402 is therefore larger than that of the waveform 405. As another example, the phase of the two waveforms may also be shifted.

To properly compute the delta (difference) between the two waveforms, waveform 402 and waveform 405 have to be aligned. For example, the peaks may have to be aligned. It is also possible that two waveforms have different number of peaks. In this case, some of the peaks in a waveform that has more peaks than the other may need to be ignored. In addition, the pitch of one waveform may need to be adjusted so that it yields a pitch that is similar to the pitch of the other waveform. In FIG. 4, for example, to align with the waveform 402, the waveform 405 may need to be shifted by $t_1'$-$t_1$ and the waveform 405 may need to be "stretched" so that peaks $P_1'$ to $P_4'$ are aligned with the corresponding peaks in waveform 402. Different alignment techniques exist in the literature and may be used to perform the necessary task.

Once the underlying waveforms are properly aligned, the delta stream 375 may be computed via subtraction. The subtraction may be performed at certain sampling rate and the resultant delta stream 375 records the differences between two waveforms at various sampling locations, representing the overall difference between the original speech data 105 and the baseline speech stream 335. The delta stream 375 is, by nature, an acoustic signal and can be compressed using any known audio compression method.

The delta compressor 380 compresses the delta stream 375 and generates the delta compression 365. FIG. 4(*b*) shows an exemplary structure of the delta compressor 380, which comprises a delta stream filter 410 and an audio signal compression mechanism 420. The delta stream filter 410 examines the delta stream 375 and generates a filtered delta stream 425. For example, the delta stream filter 410 may condense the delta stream 375 at locations where zero differences are identified. In this way, the delta stream 375 is preliminarily compressed so that the data that does not carry useful information is removed. The filtered delta stream 425 is then fed to the audio signal compression mechanism where a known compression method may be applied to compress the filtered delta stream 425.

Referring again to FIG. 3, once both the phoneme compression 355 and the delta compression 365 are generated, the integration mechanism 110*c* combined the two to generate the compressed speech data 115. In addition to the two compressed speech related streams, the compressed data 115 may also include information such as the operations performed on signals (e.g., alignment) in detecting the difference and the parameters used in such operations. Furthermore, when speaker dependent voice font is used, a speaker identification may also be included in the compressed data 115.

Figure 5:
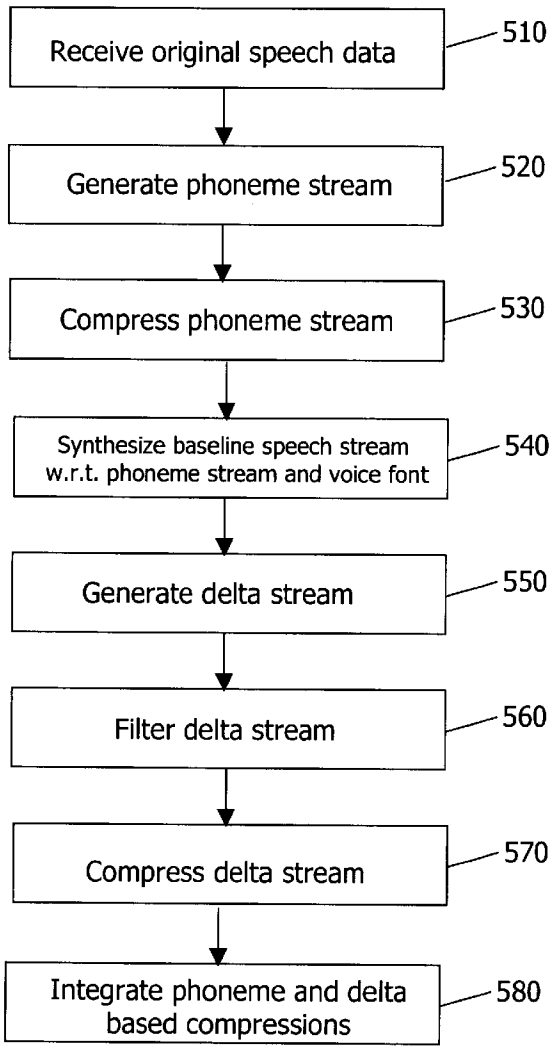
FIG. 5 shows an exemplary flowchart of a process, in which speech data is compressed based on a phoneme stream and a delta stream.

FIG. 5 is an exemplary flowchart of a process, in which the phoneme-delta based speech compression mechanism 110 compresses the original speech data 105 based on a phoneme stream and a delta stream. The original speech data 105 is first received at act 510. The phoneme stream 305 is extracted at act 520 and is then compressed at act 530. The baseline speech stream 335 is synthesized, at act 540, using the detected phoneme stream with respect to the voice font 340. Based on the baseline speech stream 335, the delta stream 365 is generated, at act 550, by detecting the deviation of the original speech data 105 from the baseline speech stream 335.

To generate the delta compression 365, the delta stream 365 is filtered, at act 560, and the filtered delta stream 425 is compressed at act 570. The phoneme compression 355, generated by the phoneme based compression channel 110*a*, and the delta compression 365, generated by the delta based compression channel 110*b*, are then integrated, at act 580, to form the compressed speech data 115.

Figure 6:
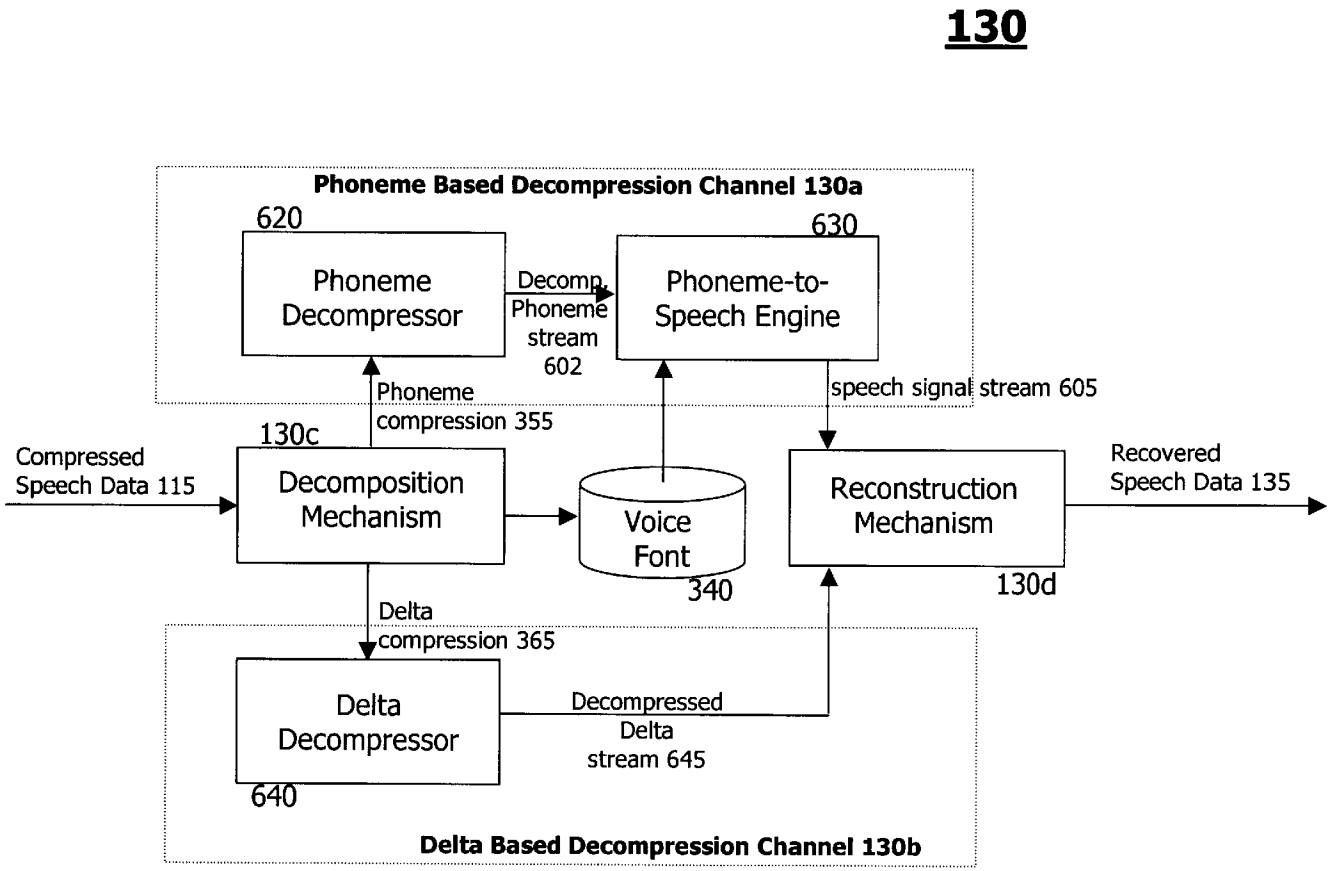
FIG. 6 depicts the internal high level structure of a phoneme-delta based speech decompression mechanism.

FIG. 6 depicts the internal high level structure of the phoneme-delta based speech decompression mechanism 130. Similar to the structure of the phoneme-delta based speech compression mechanism 110 shown in FIG. 3, the phoneme-delta based speech decompression mechanism 130 includes a phoneme based decompression channel 130*a* and a delta based decompression mechanism 130*b*. Each of the decompression channels decompresses the signal that is compressed in the corresponding channel. For example, the phoneme based decompression channel decodes a phoneme compression that is compressed by the corresponding phoneme based compression channel 110*a*. The delta based decompression channel 130*b* decodes a delta compression that is compressed by the corresponding delta based compression channel 110*b*.

To decode the compressed speech data 115 in separate channels, the decomposition mechanism 130*c*, upon receiving the compressed speech data 115, first decomposes the compressed speech data 115 into a phoneme compression 355 and a delta compression 365 and then each is sent to the corresponding decompression channel. The phoneme based decompression channel 130*a* generates a phoneme based speech stream 605, synthesized based on a decompressed phoneme stream 602. A delta decompressor 640 in the delta based decompression channel 130*b* generates a decompressed delta stream 645. Based on the decompression results from both channels, the reconstruction mechanism 130*d* integrates the phoneme based speech stream 605 and the decompressed delta stream 645 to reconstruct the recovered speech data 135.

The phoneme based decompression channel 130*a* comprises a phoneme decompressor 620 and a phoneme-to-speech engine 630. The phoneme decompressor 620 decompresses the phoneme compression 355 and generates the decompressed phoneme stream 602. Based on the phoneme stream 602, the phoneme-to-speech engine 630 synthesizes the speech stream 605 using the voice font 340. The speech stream 605 is synthesized as a baseline waveform with respect to the voice font 340. The differences recorded in the decompressed delta stream 645 is then added to the phoneme based speech stream 605 to recover the original speech data.

Figure 7:
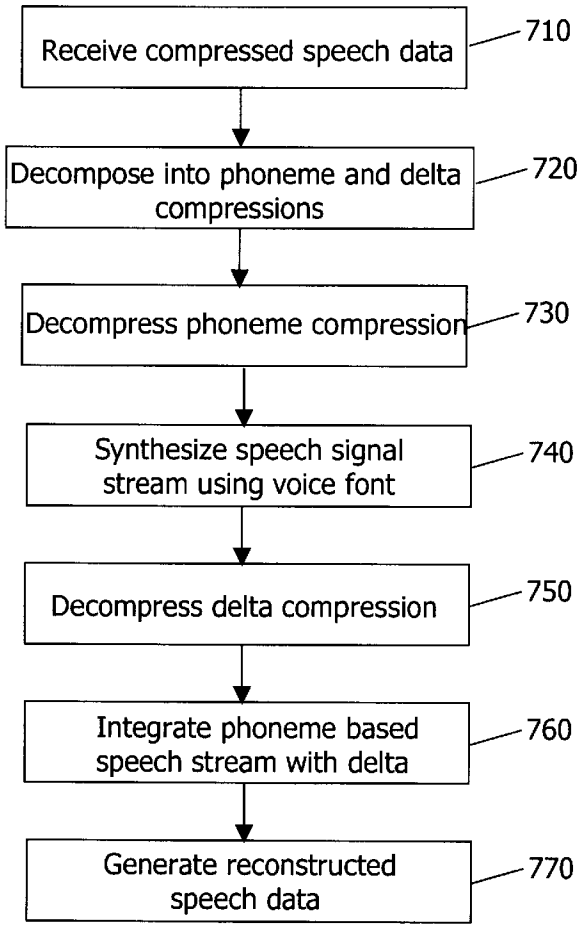
FIG. 7 is an exemplary flowchart of a process, in which a phoneme-delta based speech decompression scheme decodes received compressed speech data.

FIG. 7 is an exemplary flowchart of a process, in which the phoneme-delta based speech decompression mechanism 130 decodes received compressed speech data to recover the original speech data. Compressed speech data is first received at act 710 and then decomposed, at act 720, into a phoneme compression and a delta compression. The phoneme based decompression channel, upon receiving the phoneme compression, decompresses, at act 730, the phoneme compression to generate a phoneme stream. Using the phoneme stream, the phoneme-to-speech engine 630 synthesizes, at act 740, a phoneme based speech stream with respect to the voice font 340.

In the delta based decompression channel 130*b*, the delta compression is decompressed, at act 750, to generate a delta stream 645. The phoneme based speech stream 605 and the decompressed delta stream 645 are integrated, at act 760, to generate the recovered speech data at act 770.

Figure 8:
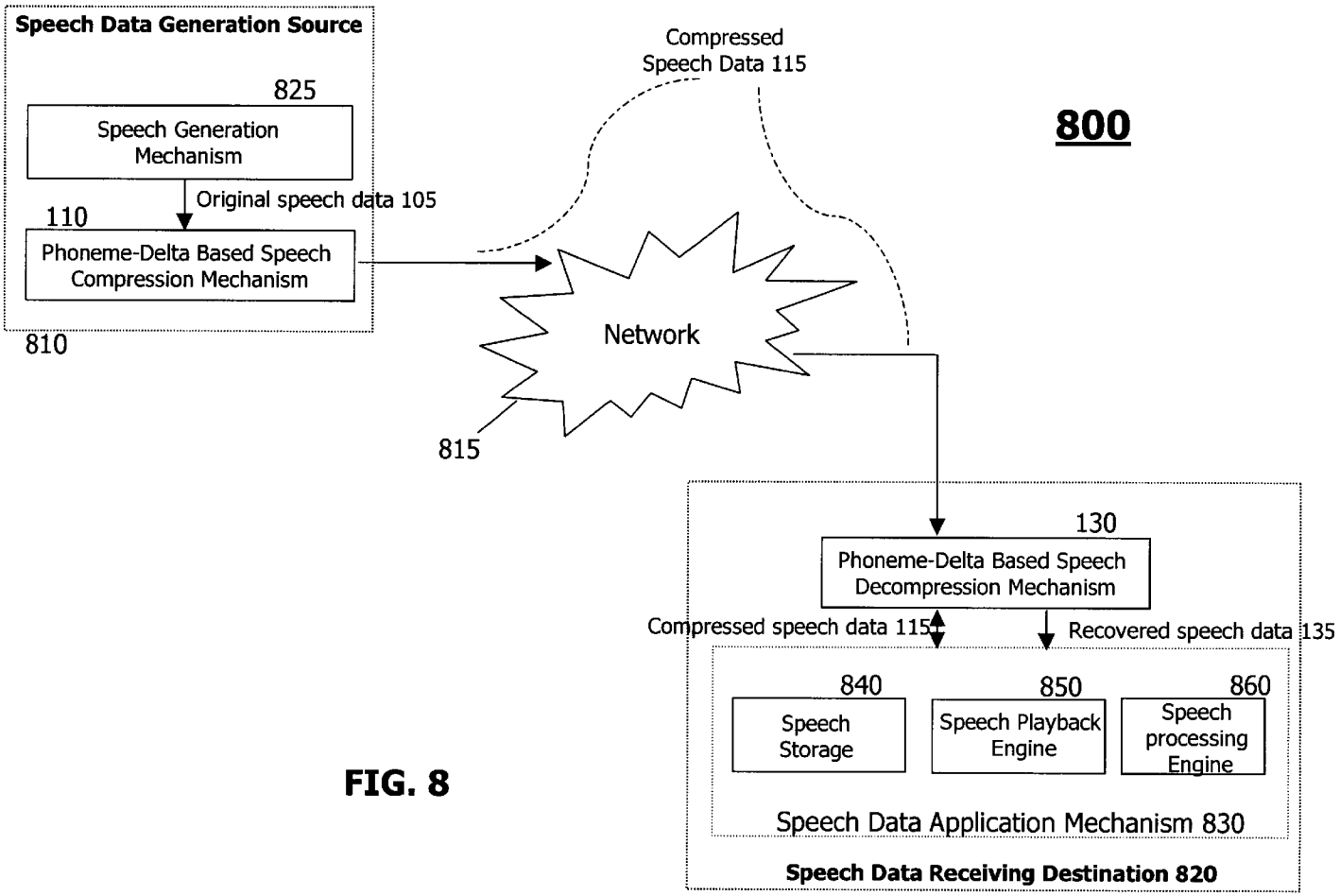
FIG. 8 depicts the high level architecture of a speech application, in which phoneme-delta based speech compression and decompression mechanisms are deployed to encode and decode speech data.

FIG. 8 depicts the high level architecture of a speech application 800, in which phoneme-delta based speech compression and decompression mechanisms (110 and 130) are deployed to encode and decode speech data. The speech application 800 comprises a speech data generation source 810 connecting to a network 815 and a speech data receiving destination 820 connecting to the network 815. The speech data generation source 810 represents a generic speech source. For example, it may be a wireless phone with speech capabilities. The speech data receiving destination 820 represents a generic receiving end that intercepts and uses compressed speech data. For example, the speech data receiving destination may correspond to a wireless base station that intercepts a voice request and reacts to the request.

The speech data generation source 810 generates the original speech data 105 and sends such speech data, in its compressed form (compressed speech data 115), to the speech data receiving destination 820 via the network 815. The speech data receiving destination 820 receives the compressed speech data 115 and uses the speech data, either in its compressed or decompressed form.

The speech data generation source 810 comprises a speech data generation mechanism 825 and the phoneme-delta based speech compression mechanism 110. When speech generation mechanism 825 generates the original speech data 105, the phoneme-delta based speech compression mechanism is activated to encode the original speech data 105. The resultant compressed speech data 115 is then sent out via the network 825.

The speech data receiving destination 820 comprises the phoneme-delta based decompression mechanism 130 and a speech data application mechanism 830. When the speech data receiving destination 820 receives the compressed speech data 115, it may invoke the phoneme-delta based speech decompression mechanism 130 to decode and to generate the recovered speech data 135. Both the recovered speech data 135 and the compressed speech data 115, can then be made accessible to the speech data application mechanism 830.

The speech data application mechanism 830 may include at least one of a speech storage 840, a speech playback engine 850, and a speech processing engine 860. Different components in the speech data application mechanism 830 may correspond to different types of usage of the received speech data. For example, the speech storage 840 may simply store the received speech data in either its compressed or decompressed form. Stored compressed speech data may later be retrieved by other speech data application modules (e.g., 850 and 860). Compressed data may also be fed, during future use, to the phoneme-delta based decompression mechanism 130, prior to the use, for decoding.

The received compressed speech data 115 may also be used for playback purposes. The speech playback engine 850 may playback the recovered speech data 135 after the phoneme-delta based decompression mechanism 130 decodes the received compressed speech data 115. It may also playback directly the compressed speech data. The speech processing engine 860 may process the received speech data. For example, the speech processing engine 860 may perform speech recognition on the received speech data or recognize speaker identification based on the received speech data. The speech analysis carried out by the speech processing engine 860 may be performed on either the recovered speech data (decompressed) or on the compressed speech data 115 directly.

Figure 9:
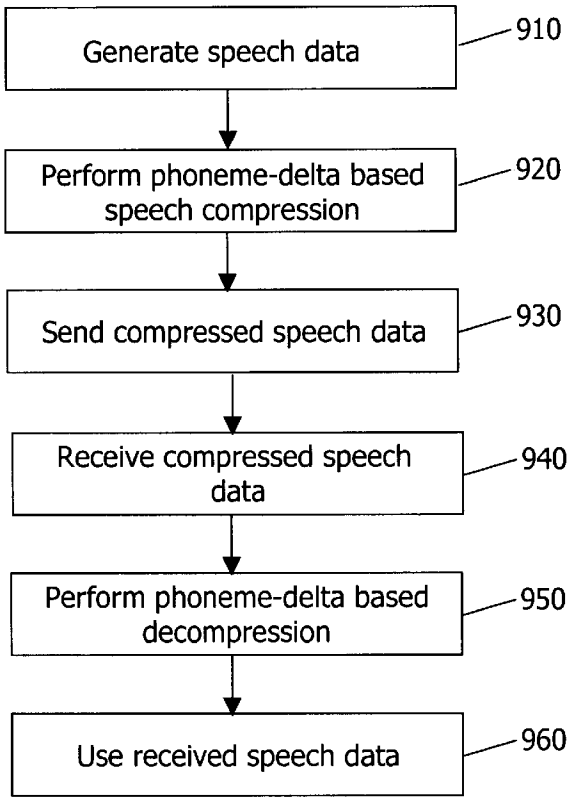
FIG. 9 is an exemplary flowchart of a process, in which a speech application applies phoneme-delta based speech compression and decompression mechanisms.

FIG. 9 is an exemplary flowchart of a process, in which the speech application 800 applies phoneme-delta based speech compression and decompression mechanisms 110 and 130. The speech data generation source 810 first produces, at act 910, original speech data 115. Prior to sending the original speech data 105 to the speech data receiving destination 820, a phoneme-delta based speech compression mechanism 110 is invoked to perform, at act 920, phoneme-delta based speech compression. The generated compressed speech data 115 is sent, at act 930, to the speech data receiving destination 820. Upon receiving the compressed speech data 115 at act 940, the phoneme-delta based speech decompression mechanism 130 decompresses, at act 950, the compressed speech data 115 and generates the recovered speech data 135. The received speech data, in both the compressed form and the decompressed form, is used at act 960. Such use may include storage, playback, or further analysis of the speech data.

While the invention has been described with reference to the certain illustrated embodiments, the words that have been used herein are words of description, rather than words of limitation. Changes may be made, within the purview of the appended claims, without departing from the scope and spirit of the invention in its aspects. Although the invention has been described herein with reference to particular structures, acts, and materials, the invention is not to be limited to the particulars disclosed, but rather extends to all equivalent structures, acts, and, materials, such as are within the scope of the appended claims.

What is claimed is:

1. A method, comprising:

receiving original speech data;

compressing the original speech data based on a phoneme stream, detected from the original speech data, and a delta stream, extracted based on the difference between a speech signal stream, generated using the phoneme stream with respect to a voice font, and the original speech data, to generate compressed speech data;

sending the compressed speech data;

receiving the compressed speech data; and decompressing the compressed speech data based on a decompressed phoneme stream and a decompressed delta stream to generate recovered speech data.

2. The method according to claim 1, wherein the compressing the original speech data comprises:

extracting the phoneme stream from the original speech data;

compressing the phoneme stream to generate phoneme compression;

generating the delta stream based on the difference between the speech signal stream generated using the phoneme stream with respect to the voice font and the original speech data;

compressing the delta stream to generate delta compression; and integrating the phoneme compression and the delta compression to generate the compressed speech data.

3. The method according to claim 2, wherein the decompressing the compressed speech data comprises:

decomposing the compressed speech data into the phoneme compression and the delta compression;

decompressing the phoneme compression to generate a decompressed phoneme stream;

decompressing the delta compression to generate a decompressed delta stream; and generating the recovered speech data based on the decompressed phoneme stream and the decompressed delta stream.

4. A method for phoneme-delta based speech compression, comprising:

receiving original speech data;

compressing a phoneme stream, extracted from the original speech data, to generate phoneme compression;

compressing a delta stream, extracted based on the difference between a speech signal stream, generated based on the phoneme stream with respect to a voice font, and the original speech data, to generate delta compression; and integrating the phoneme compression and the delta compression to generate compressed speech data.

5. The method according to claim 4, wherein the compressing the phoneme stream comprises:

extracting a plurality of phonemes from the original speech data to generate the phoneme stream; and compressing the phoneme stream.

6. The method according to claim 4, wherein the compressing the delta stream comprises:

generating the speech signal stream based on the phoneme stream with respect to the voice font;

generating the delta stream based on the difference between the speech signal stream and the original speech data; and compressing the delta stream.

7. A method for phoneme-delta based speech decompression, comprising:

receiving compressed speech data that is compressed based on a phoneme compression and a delta compression;

decompressing the phoneme compression to generate a phoneme based speech signal stream;

decompressing the delta compression to generate a decompressed delta stream; and generating recovered speech data by integrating the phoneme based speech signal stream with the decompressed delta stream.

8. The method according to claim 7, wherein the decompressing the phoneme compression comprises:

decompressing the phoneme compression to generate a decompressed phoneme stream; and synthesizing the phoneme based speech signal stream based on the decompressed phoneme stream with respect to a voice font.

9. A method for use of phoneme-delta based speech compression and decompression, comprising:

generating original speech data;

performing phoneme-delta based speech compression on the original speech data to generate compressed speech data;

sending the compressed speech data;

receiving the compressed speech data;

performing phoneme-delta based speech decompression on the received compressed speech data to generate a recovered speech data.

10. The method according to claim 9, further comprising at least one of:

storing the compressed speech data, received by the receiving;

analyzing the compressed speech data, received by the receiving;

playing back the compressed speech data;

storing the recovered speech data;

analyzing the recovered speech data; and playing back the recovered speech data.

11. A system, comprising:

a phoneme-delta based speech compression mechanism for compressing original speech data based on a phoneme stream, detected from the original speech data, and a delta stream, extracted based on the difference between a speech signal stream, generated using the phoneme stream with respect to a voice font, and the original speech data, to generate compressed speech data comprising phoneme compression and delta compression; and a phoneme-delta based speech decompression mechanism for decompressing the compressed speech data with the phoneme compression and the delta compression to generate a recovered speech data.

12. The system according to claim 11, wherein:

the phoneme-delta based speech compression mechanism comprises:

a phoneme based compression channel that compresses the original speech data according to the phoneme stream to generate the phoneme compression;

a delta based compression channel that compresses the original speech data according to the delta stream to generate the delta compression; and an integration mechanism for integrating the phoneme compression with the delta compression to generate the compressed speech data, the phoneme-delta based speech decompression mechanism comprises:

a phoneme based decompression channel that decompresses the phoneme compression to produce a decompressed phoneme stream based on which a phoneme based speech stream is generated with respect to the voice font;

a delta based decompression channel that decompresses the delta compression to generate the delta stream; and a reconstruction mechanism for constructing the recovered speech data based on the phoneme based speech stream and the delta stream.

13. A system for phoneme-delta based speech compression, comprising:

a phoneme based speech compression channel for compressing original speech data according to a phoneme stream, detected from the original speech data, to generate a phoneme compression;

a delta based compression channel for compressing the original speech data according to a delta stream, determined according to the difference between a speech signal stream, generated based on the phoneme stream with respect to a voice font, and the original speech data, to generate a delta compression; and an integration mechanism for integrating the phoneme compression with the delta compression to generate compressed speech data.

14. The system according to claim 13, wherein the phoneme based compression channel comprises:

a phoneme recognizer for detecting the phoneme stream from the original speech data;

a phoneme-to-speech engine for synthesizing the speech signal stream using the phoneme stream with respect to the voice font; and a phoneme compressor for compressing the phoneme stream to generate the phoneme compression.

15. The system according to claim 14, wherein the delta based compression channel comprises:

a delta detection mechanism for extracting the delta stream based on the difference between the original speech data and the speech signal stream; and a delta compressor for compressing the delta stream to generate the delta compression.

16. The system according to claim 15, the delta compressor comprises:

a delta stream filter for filtering the delta stream to generate a filtered delta stream; and an audio signal compression mechanism for compressing the filtered delta stream to generate the delta compression.

17. A system for phoneme-delta based speech decompression, comprising:

a decomposition mechanism for decomposing a phoneme-delta based compressed speech data into a phoneme compression and a delta compression;

a phoneme based decompression channel that decompresses the phoneme compression to produce a phoneme based speech stream generated with respect to a voice font;

a delta based decompression channel with a delta based decompressor for decompressing the delta compression to generate a delta stream; and a reconstruction mechanism for constructing recovered speech data based on the phoneme based speech stream and the delta stream.

18. The system according to claim 17, wherein the phoneme based decompression channel comprises:

a phoneme decompressor for decompressing the phoneme compression to generate a decompressed phoneme stream; and a phoneme-to-speech engine for synthesizing the phoneme based speech stream based on the decompressed phoneme stream with respect to the voice font.

19. A system, comprising:

a speech data generation source for generating original speech data and for sending compressed speech data encoded using a phoneme-delta based speech compression scheme, the compressed speech data being generated based on a phoneme stream and a delta stream, both detected based on the original speech data;

a speech data receiving destination for use of speech data recovered from the compressed speech data.

20. The system according to claim 19, wherein the speech data generation source comprises:

a speech data generation mechanism for generating the original speech data; and a phoneme-delta based speech compression mechanism for compressing the original speech data based on a phoneme stream and a delta stream to generate the compressed speech data.

the speech data receiving destination comprises:

a phoneme-delta based speech decompression mechanism for decompressing the compressed speech data to generate the recovered speech data;

a speech data application mechanism for utilizing the compressed speech data and the recovered speech data.

21. A computer-readable medium encoded with a program in a receiving network end point, the program, when executed, causing:

receiving a plurality of packets, sent from an initiating network end point, with a corresponding plurality of destination spacings between pairs of adjacent received packets;

deriving an average destination spacing based on the destination spacings; and sending the plurality of destination spacings and the average destination spacing.

22. The medium according to claim 21, the program, when executed, further causing:

receiving an average actual source spacing and an inter-departure jitter measure, sent from the initiating network end point; and estimating the jitter between the initiating network end point and the receiving network end point and an associated confidence measure based on the average actual source spacing, the inter-departure jitter measure, the destination spacings, and the average destination spacing.

23. A computer-readable medium encoded with a program, the program, when executed, causing:

receiving original speech data;

compressing the original speech data based on a phoneme stream, detected from the original speech data, and a delta stream, extracted based on the difference between a speech signal stream, generated using the phoneme stream with respect to a voice font, and the original speech data, to generate compressed speech data;

sending the compressed speech data;

receiving the compressed speech data; and decompressing the compressed speech data based on a decompressed phoneme stream and a decompressed delta stream to generate recovered speech data.

24. The medium according to claim 23, wherein the compressing the original speech data comprises:

extracting the phoneme stream from the original speech data;

compressing the phoneme stream to generate phoneme compression;

generating the delta stream based on the difference between the speech signal stream generated using the phoneme stream with respect to the voice font and the original speech data;

compressing the delta stream to generate delta compression; and integrating the phoneme compression and the delta compression to generate the compressed speech data.

25. The medium according to claim 23, wherein the decompressing the compressed speech data comprises:

decomposing the compressed speech data into the phoneme compression and the delta compression;

decompressing the phoneme compression to generate a decompressed phoneme stream;

decompressing the delta compression to generate a decompressed delta stream; and generating the recovered speech data based on the decompressed phoneme stream and the decompressed delta stream.

26. A computer-readable medium encoded with a program for phoneme-delta based speech compression, the program, when executed, causing:

receiving original speech data;

compressing a phoneme stream, extracted from the original speech data, to generate phoneme compression;

compressing a delta stream, extracted based on the difference between a speech signal stream, generated based on the phoneme stream with respect to a voice font, and the original speech data, to generate delta compression; and integrating the phoneme compression and the delta compression to generate compressed speech data.

27. The medium according to claim 26, wherein the compressing the phoneme stream comprises:

extracting a plurality of phonemes from the original speech data to generate the phoneme stream; and compressing the phoneme stream.

28. The medium according to claim 26, wherein the compressing the delta stream comprises:

generating the speech signal stream based on the phoneme stream with respect to the voice font;

generating the delta stream based on the difference between the speech signal stream and the original speech data; and compressing the delta stream.

29. A computer-readable medium encoded with a program for phoneme-delta based speech decompression, the program, when executed, causing:

receiving compressed speech data that is compressed based on a phoneme compression and a delta compression;

decompressing the phoneme compression to generate a phoneme based speech signal stream;

decompressing the delta compression to generate a decompressed delta stream; and generating recovered speech data by integrating the phoneme based speech signal stream with the decompressed delta stream.

30. The medium according to claim 29, wherein the decompressing the phoneme compression comprises:

decompressing the phoneme compression to generate a decompressed phoneme stream; and synthesizing the phoneme based speech signal stream based on the decompressed phoneme stream with respect to a voice font.

31. A computer-readable medium encoded with a program for use of phoneme-delta based speech compression and decompression, the program, when executed, causing:

generating original speech data;

performing phoneme-delta based speech compression on the original speech data to generate compressed speech data;

sending the compressed speech data;

receiving the compressed speech data;

performing phoneme-delta based speech decompression on the received compressed speech data to generate a recovered speech data.

32. The medium according to claim 31, the program, when executed, further causing at least one of:

storing the compressed speech data, received by the receiving;

analyzing the compressed speech data, received by the receiving;

playing back the compressed speech data;

storing the recovered speech data;

analyzing the recovered speech data; and playing back the recovered speech data.

* * * * *